United States Patent [19]

Canard et al.

[11] 4,130,691

[45] Dec. 19, 1978

[54] CHEMICAL COMPOSITION

[75] Inventors: Pierre Canard, Versailles; Albert Levy, Orly, both of France

[73] Assignee: Rhone Poulenc Industries, Paris, France

[21] Appl. No.: 666,489

[22] Filed: Mar. 12, 1976

[51] Int. Cl.[2] ..... D21H 1/28

[52] U.S. Cl. ..... 428/511; 260/29.7 H; 260/29.7 T

[58] Field of Search ..... 260/29.7 H, 29.7 T; 428/511

[56] References Cited

U.S. PATENT DOCUMENTS

| | | | |
|---|---|---|---|
| 3,432,455 | 3/1969 | Rasicci | 260/29.7 |
| 3,784,498 | 1/1974 | Ceska | 260/29.6 TA |
| 3,793,244 | 2/1974 | Megee et al. | 260/29.7 H |
| 3,817,899 | 6/1974 | Turck | 260/29.7 SQ |
| 3,966,661 | 6/1976 | Feast et al. | 260/29.7 H |

OTHER PUBLICATIONS

Noble, "Latex in Industry", p. 184, 2d Ed. 1953, Palmerton Publishing Co.

*Primary Examiner*—Harold D. Anderson
*Assistant Examiner*—E. A. Nielsen
*Attorney, Agent, or Firm*—McDougall, Hersh & Scott

[57] ABSTRACT

A coated paper for offset printing in which the paper is coated with an aqueous latex containing particles of a diameter within the range of 0.20 to 0.30 microns of a copolymer of butadiene styrene and unsaturated carboxylic acid having a composition consisting essentially of 35–40% by weight butadiene, 50–63% by weight styrene and 2–10% by weight of at least one unsaturated carboxylic ethylenic acid.

6 Claims, No Drawings

CHEMICAL COMPOSITION

The present invention is concerned with aqueous compositions for the coating of paper for offset printing and the paper coated with such compositions.

It is well known that aqueous compositions for the coating of paper mainly contain pigments and binding agents. The most frequently used pigment is mineral clay. Use may also be made, in small proportions in relation to the mineral clay, of other pigments such as calcium carbonate, titanium oxide, hydrargillite, talc and barium sulphate. These pigments are dispersed in water, generally in an alkaline medium and in the presence of dispersing agents, the most important of which are tetrasodium pyrophosphate, sodium hexametaphosphate and polyacrylates of low molecular weight, in amounts of between 0.2 and 0.5% by weight based on the pigments. These pigments are fixed on the paper by means of binding agents. The binding agent generally used in an aqueous dispersion of a synthetic polymer, such as a copolymer of styrene and butadiene, an acrylic polymer on a polymer of vinyl acetate, used either alone or mixed with natural binding agents, such as starches, proteins, and casein, or synthetic binding agents such as polyvinyl alcohols. It is also possible to use the aqueous dispersions in conjunction with products capable of improving the water-retaining properties of the coating compositions, examples of such products being carboxymethyl cellulose or alginates.

Finally, the coating compositions may contain various other ingredients: in particular, cross-linking agents, anti-foaming agents, slip-inducing agents, bluing agents and colorants.

The paper is coated with the aqueous compositions by means of a coating machine based on any one of various techniques and involving various arrangements, among which may be mentioned those known industrially under the names: air blade, size press, Champion coating machine, Massey coating machine and trailing spreader apparatus. After the paper has been coated it is dried.

Offset printing, in which the ink that is used is very viscous, requires the use of a paper having a high dry-tearing strength; the quantity of binding agent to be used is considerable and generally lies within the range 14 to 18 parts by weight per 100 parts by weight of pigment.

However, the offset printing process, which is based on the repulsion of water by the oily inks, in fact makes use of water. In four-color printing, it is therefore necessary to print the second, third or fourth color on a previously moistened area. Therefore, to avoid tearing in the wet condition, which results in crushing of the filter-cloth and the offset presses, it is important for the paper to have a sufficiently high wet-tearing strength.

According to the invention, an aqueous composition for coating paper for offset printing contains a film-forming material the main constituent of which is an aqueous latex of a copolymer of butadiene styrene and unsaturated carboxylic acid consisting of 35 to 40% by weight of butadiene, 50 to 65% by weight of styrene, and 2 to 10% by weight of at least one unsaturated carboxylic ethylenic acid, the particles of which have a diameter of between 0.20 and 0.30 micron.

By using the smallest possible amount of the film-forming constituent, which performs the function of a binding agent, the compositions forming the subject matter of the invention enable a coated paper for use in offset printing to be obtained that has high dry and wet tearing strengths.

To enable the compositions of the invention to be efficiently used, the carboxylic acid content in the copolymer is in the range from 3 to 6% by weight. The unsaturated carboxylic ethylenic acids used in accordance with the invention include in particular acrylic acid, methacrylic acid, itaconic acid and fumaric acid.

The following examples are given by way of illustration, but not by way of limitation, of the practice of the invention and provide comparative data.

EXAMPLES 1 TO 12

Aqueous coating compositions were prepared, and a layer of 20 g/m$^2$, in terms of dry substance, of each of the said compositions was applied to a 52 g/m$^2$ paper with the aid of a coating machine of the air-blade type. The paper coated in this way was dried in a drying tunnel at a temperature of 100° C. and was then calendered by four successive passes between two rollers under a pressure of 80 kg/cm.

After drying and calendering, the coated paper was conditioned at a temperature of 20° C. in an atmosphere having a relative humidity of 65%, and was then examined for dry and wet tear strength with the aid of the following methods:

Dry-tear strength was determined with the aid of the IGT apparatus designed by the Institut von Grafische Technik in which the paper is contacted with an inking roller, the pressure of which on the paper is adjusted to a selected value, and the speed of which increases until commencement of tearing of the inked layer is observed.

Dry-tear strength is determined by the speed at which tearing begins. The ink used was "3805" graduated absorption ink sold by Etablissements Lorilleux Lefranc.

Wet-tear strength was also determined with the aid of the IGT apparatus, but inking is carried out with a coated paper sample on which a thin film of water has previously been deposited. Wet-tear strength is determined visually by comparison with other samples. The ink used was the "3801" ink sold by Etablissements Lorilleux Lefranc. The results are expressed by a figure ranging from 0 to 10, the FIG. 0 corresponding to a paper having a very poor strength, and the FIG. 10 to a paper having a very good strength.

Table 1 which follows gives the details of the latexes A, B, C, D, E, F, G, H, I, J, K and L at 50% by weight of dry substance, of copolymers of butadiene styrene and unsaturated carboxylic acid, as used in Examples 1 to 12 respectively.

TABLE 1

| Ex. | Latex | Butadiene by weight % | Acids by weight % | Styrene by weight % | Particle diameter micron |
|---|---|---|---|---|---|
| 1 | A | 32 | 4 | 64 | 0.15 |
| 2 | B | 32 | 4 | 64 | 0.18 |
| 3 | C | 32 | 4 | 64 | 0.23 |
| 4 | D | 32 | 4 | 64 | 0.28 |
| 5 | E | 37 | 4 | 59 | 0.15 |
| 6 | F | 37 | 4 | 59 | 0.18 |
| 7 | G | 37 | 4 | 59 | 0.23 |
| 8 | H | 37 | 4 | 59 | 0.28 |
| 9 | I | 43 | 4 | 53 | 0.15 |
| 10 | J | 43 | 4 | 53 | 0.18 |
| 11 | K | 43 | 4 | 53 | 0.23 |
| 12 | L | 43 | 4 | 53 | 0.28 |

Table 2 shows the nature and content by weight of the solid constituents of the coating compositions corresponding to each of the examples.

The coating compositions were brought to a pH value of 8.5 by the addition of ammonia. They were adjusted with water to conatin 60% by weight of dry substance. Five tests, corresponding to five different amounts of copolymer of butadiene styrene and unsaturated carboxylic acid were carried out for each sample.

TABLE 2

| | Test 1 | Test 2 | Test 3 | Test 4 | Test 5 |
|---|---|---|---|---|---|
| Kaolin | 100 | 100 | 100 | 100 | 100 |
| Sodium pyrophosphate | 0.4 | 0.4 | 0.4 | 0.4 | 0.4 |
| Copolymer of butadiene styrene and unsaturated carboxylic acid. | 13 | 14 | 15 | 16 | 17 |

Tables 3 and 4 show the properties of the coated paper for each of the five tests on each of the Examples 1 to 6 and each of the Examples 7 to 12 respectively.

TABLE 3

| Test | Parts by weight of copolymer of butadiene, styrene and unsaturated carboxylic acid per 100 parts by weight of pigment | Example / Latex | 1 / A | 2 / B | 3 / C | 4 / D | 5 / E | 6 / F |
|---|---|---|---|---|---|---|---|---|
| 1 | 13 | IGT dry (cm/s) | <30 | <30 | <30 | <30 | 40 | 42 |
| | | IGT wet | 3 | 3 | 2 | 2 | 5 | 4 |
| 2 | 14 | IGT dry (cm/s) | <30 | <30 | <30 | <30 | 50 | 52 |
| | | IGT wet | 4 | 5 | 5 | 4 | 6 | 6 |
| 3 | 15 | IGT dry (cm/s) | <30 | <30 | <30 | <30 | 60 | 60 |
| | | IGT wet | 6 | 6 | 5 | 6 | 6 | 6 |
| 4 | 16 | IGT dry (cm/s) | 48 | 48 | 53 | 60 | 63 | 65 |
| | | IGT wet | 7 | 7 | 6 | 7 | 7 | 7 |
| 5 | 17 | IGT dry (cm/s) | 64 | 62 | 68 | 70 | 78 | 78 |
| | | IGT wet | 8 | 8 | 7 | 7 | 8 | 8 |

TABLE 4

| Test | Parts by weight of copolymer of butadiene styrene and unsaturated carboxylic acid per 100 parts by weight of pigment | Example / Latex | 7 / G | 8 / H | 9 / I | 10 / J | 11 / K | 12 / L |
|---|---|---|---|---|---|---|---|---|
| 1 | 13 | IGT dry (cm/s) | 40 | 43 | 54 | 56 | 58 | 58 |
| | | IGT wet | 5 | 5 | 4 | 4 | 3 | 3 |
| 2 | 14 | IGT dry (cm/s) | 60 | 60 | 62 | 62 | 64 | 70 |
| | | IGT wet | 6 | 6 | 4 | 4 | 5 | 5 |
| 3 | 15 | IGT dry (cm/s) | 63 | 70 | 66 | 72 | 74 | 84 |
| | | IGT wet | 6 | 6 | 5 | 6 | 5 | 6 |
| 4 | 16 | IGT dry (cm/s) | 69 | 75 | 83 | 80 | 76 | 100 |
| | | IGT wet | 7 | 7 | 7 | 6 | 6 | 7 |
| 5 | 17 | IGT dry (cm/s) | 82 | >100 | >100 | >100 | >100 | >100 |
| | | IGT wet | 8 | 8 | 8 | 7 | 8 | 8 |

The aqueous coating compositions that produced a coated paper of satisfactory quality for use in offset printing are those for which, under the above test conditions, the dry tear strength is at least 60 cm/s and the wet tear strength is at least 6.

Examples 1, 2, 3, 4, 6, 9, 10, 11 and 12 are provided for comparison purposes.

Examples 7 and 8 are in accordance with the invention.

It will be seen that, of the various latexes studied, only the latexes G and H used in Examples 7 and 8 enable aqueous compositions to be obtained that provide a satisfactory quality of coated paper for use in offset printing, in the case where only 14 parts by weight of binding agent per 100 parts by weight of pigment is used.

We claim:

1. A coated offset printing paper comprising a paper base sheet and a coating on the paper base sheet, consisting essentially of a pigment and binder in which the principal film-forming constituent consists of an aqueous latex of a copolymer of butadiene, styrene and unsaturated carboxylic acid, consisting essentially of 35 to 40% by weight of butadiene, 50 to 63% by weight of styrene, and 2 to 10% by weight of at least one unsaturated carboxylic ethylenic acid, the particles of which have a diameter in the range 0.20 to 0.30 micron in which the film forming constituent is present in the ratio of 14–15 parts by weight per 100 parts by weight of pigment.

2. A coated offset printing paper as claimed in claim 1, in which the content of carboxylic acid in the copolymer is from 3 to 6% by weight.

3. A coating offset printing paper as claimed in claim 1, in which the carboxylic acid is selected from the group consisting of acrylic acid, methacrylic acid, itaconic acid or fumaric acid.

4. A method for producing coated papers for offset printing comprising coating a paper base sheet with a composition containing as the principal film forming constituent, an aqueous latex of a carboxylized copolymer of butadiene and styrene, consisting essentially of 35 to 40% by weight of butadiene, 50 to 63% by weight of styrene, and 2 to 10% by weight of at least one unsaturated carboxylic ethylenic acid, the particles of which have a diameter in the range 0.20 to 0.30 micron.

5. A method as claimed in claim 4, in which the carboxylic acid is present in the copolymer in an amount within the range of 3 to 6% by weight.

6. A method as claimed in claim 4, in which the carboxylized acid is selected from the group consisting of acrylic acid, methacrylic acid, itaconic acid and fumaric acid.

* * * * *